US005765807A

United States Patent [19]

Heath

[11] Patent Number: 5,765,807

[45] Date of Patent: Jun. 16, 1998

[54] GUTTER HAMMER

[76] Inventor: Cecil Earl Heath, 220 Bennett Dr., Old Hickory, Tenn. 37138

[21] Appl. No.: 754,898

[22] Filed: Nov. 22, 1996

[51] Int. Cl.[6] ..... B25C 11/00

[52] U.S. Cl. ..... 254/26 R

[58] Field of Search ..... 254/26 R, 26 E; 81/20, 21, 22, 23, 24, 25, 26

[56] References Cited

U.S. PATENT DOCUMENTS

| | | | |
|---|---|---|---|
| 1,957,760 | 5/1934 | Cownie | 254/26 R |
| 1,991,433 | 2/1935 | Vaughan | 254/26 R |
| 2,239,719 | 4/1941 | Jarrett | 254/26 R |
| 2,365,463 | 12/1944 | Formhals | 254/26 R |

FOREIGN PATENT DOCUMENTS

| | | | |
|---|---|---|---|
| 1335243 | 7/1963 | France | 81/24 |
| 2178993 | 2/1987 | United Kingdom | 81/26 |

*Primary Examiner*—Robert C. Watson
*Attorney, Agent, or Firm*—John P. Halvonik

[57] ABSTRACT

The invention comprises a specially designed hammer adapted for driving and removing gutter spikes typically used to hold the gutters at the edge of the roof. Such hammer has a specially shaped groove or claw at the rear that has a straight channel that is adapted to hold the heads of gutter spikes as they are removed. The top portion of the head of the hammer has a knocker head that is raised above the rest of the head and is adapted for hammering upon so that the claw portions can be used to remove gutter spikes. The head is of one piece construction and is preferably made of metal such as steel. The front portion or head of the hammer is broader than standard and is of flat shape in order to maintain contact with gutter spikes during the hammering process.

2 Claims, 1 Drawing Sheet

GUTTER HAMMER

FIELD AND BACKGROUND OF THE INVENTION

The invention relates to the field of hammers and in particular to a claw hammer that is designed for use on gutters and in particular for use in backing out gutter spikes and driving the same.

Gutter spikes are typically long spikes of about 7" or more and are commonly found in use on gutters and are used to secure the gutters to the edge of the roof. Commonly available hammers are not effective at removing such spikes because they have a slight curvature to them and are liable to slip off the spikes during the hammering process. Gutter workers have found a hard time using normal hammers on guttering operations that involve the spikes, such as driving spikes, removing spikes or holding the spikes.

It is believed that by providing a specially shaped gutter hammer for such spikes, that the guttermen's job can be made easier. Using a flat shaped hammering head will insure that the gutterman will continue to make contact with the spike during the hammering process. It is thought that by making the claw portion of the head straighter in shape than is normal and having a straight shaped groove at the claw adapted for gutter spikes this will allow a gutterman to use one hammer for all the operations on the edge of the roof that involve gutter spikes.

The use of the straight channel insures that the claw can secure the head of the gutter spike. A steel knocker head further adds to the process because it allows the worker to hammer on the knocker head in order to help provide leverage on the spike. It is believed that the use of an upraised knocker head will allow the gutterman to back out spikes without doing damage to the top of the hammer.

SUMMARY OF THE INVENTION

The invention comprises a specially designed hammer adapted for driving and removing gutter spikes typically used to hold the gutters at the edge of the roof. Such hammer has a specially shaped groove or claw at the rear that has a straight channel that is adapted to hold the heads of gutter spikes as they are removed. The top portion of the head of the hammer has a knocker head that is raised above the rest of the head and is adapted for hammering upon so that the claw portions can be used to remove gutter spikes. The head is of one piece construction and is preferably made of metal such as steel. The front portion or head of the hammer is broader than standard and is of flat shape in order to maintain contact with gutter spikes during the hammering process.

It is an object of the invention to make a hammer available for guttermen that will be sturdy enough to withstand the hammering used in removing gutter spikes and other types of nails in the guttering industry.

Another object is to provide a hammer for guttermen that has a flat shaped hammering head in order to insure contact with gutter spikes that are being hammered.

Another object is to provide a spike hammer having claw portions that are of size and shape adapted for removing gutter spikes.

Other objectives will become known to those skilled in the art once the invention is shown and described.

DESCRIPTION OF THE PREFERRED EMBODIMENT

Figure 1:
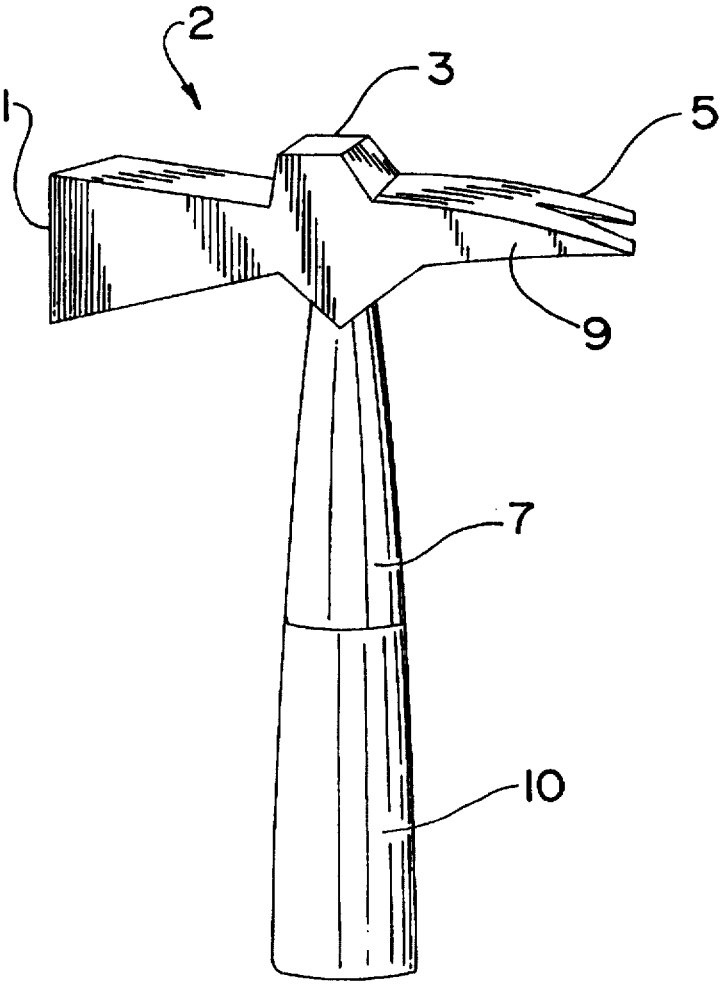
FIG. 1 is a perspective view of the hammer.

The invention is shown in appearance in FIG. 1. The head is shown generally as 2 and is connected to a handle 9. The top portion 3 of the middle part of the head of the hammer is known as the knocker head and is upraised in relation to the claw portion 5 and the hammering head 1. It is preferred that this knocker head be upraised by about ¼" in relation to the other parts of the top of the head. It is believed that such a construction will allow the head to be used for backing out gutter spikes.

That upper portion of the handle 7 that connects to the head should also be of solid metal construction and may be made as part of the same piece with the head. The lower part of the handle 10 may be of wood or other materials and need not be part of the same piece as the head.

The rear of the hammer is known as the claw portion and is used to leverage on gutter spikes and the like in order to remove them from the gutter. This portion has two projection portions or claws 5 that come together to form a channel 20. Unlike hammers in common use today, this channel should be straight in shape as each claw should be relatively parallel to the other portion at least for the initial 1" starting at the point where the opening between the two claws begins. Eventually, the two portions will come together at an angle but the channel should be of relatively straight shape at the end of the channel where the gutter spike enters the channel.

The gutterman may use this portion of the hammer to leverage on nails, gutter spikes, etc. The gutterman may take a second hammer and pound on the knocker head in order to accomplish this purpose.

The top surface of the claws should be relatively straight as seen in FIG. 1. Thus, the angle that portion 9 makes with a line drawn across the top of the knocker head 3 will be 10° or less. The straight portion of the channel should be about 1" and the width of the channel, that is the distance between the two claws 5, should be at least ¼" in width for the greater part of this distance. This shape will assist the gutterman in removing roofing spikes and other types of nails from the wood, metal etc.

Figure 2:
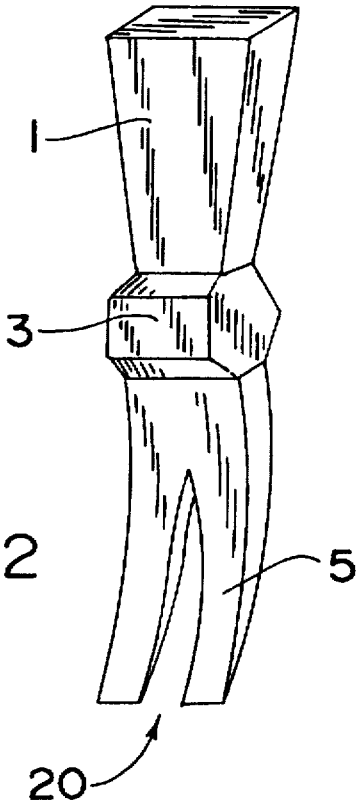
FIG. 2 is a top view of the hammer.

The front part of the head 1 is the hammering head. This portion should be of relatively wide construction in order to have good effect on driving large gutter spikes. It is preferred that the front surface of this head be about 1¼"×1¼ or similar size. As seen in FIG. 2 each of the claws 10 should be about ½" wide as seen from the top and about ½" in width at their widest part (near the entrance opening). It is preferred that the knocker head 3 should be about 1" in width and about ¼" in height in relation to the head and the claws. The hammering head 1 should be about 2" in length and the length of the head including the claws should be about 6" in length.

The head including the hammering head, the knocker head and the claws, should be made of solid metal construction with steel being the preferred metal. The handle 10 may be attached separately to the middle part of the head and at a point opposite the knocker head. There may be an extended portion of the head 7 that extends below the knocker head in order to attach to the handle. The handle length could vary according to the needs, it may be 6" in length more or less.

I claim:

1. An improved hammer for use in leveraging gutter spikes comprising: a hammer having a handle and a head, said handle attached to said head at about the middle of said head, said head comprising a hammering head at the front of said head, a knocker head opposite said handle and a pair of claws at the rear of said head, said knocker head having a relatively flat striking surface, said claws having an upper surface that is about parallel to said striking surface, so that a plane drawn across said striking surface will form an angle of about 10° with said upper surface of said claws, said claws in parallel relation to each other so as to form a channel between said claws, said channel of about ¼" in width and of relatively straight shape, said knocker head being raised about ¼" above the level of said upper surface so that said channel may be used to help remove gutter spikes.

2. The apparatus of claim 1 wherein said hammering head, said knocker head and said claws are made of integral construction and are made of metal.

* * * * *